US011446944B2

(12) United States Patent
Hamada

(10) Patent No.: US 11,446,944 B2
(45) Date of Patent: Sep. 20, 2022

(54) IMAGE FORMING APPARATUS AND METHOD FOR CONTROLLING IMAGE FORMING APPARATUS

(71) Applicant: KYOCERA Document Solutions Inc., Osaka (JP)

(72) Inventor: Takuya Hamada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 177 days.

(21) Appl. No.: 16/986,171

(22) Filed: Aug. 5, 2020

(65) Prior Publication Data

US 2021/0039413 A1 Feb. 11, 2021

(30) Foreign Application Priority Data

Aug. 7, 2019 (JP) ..... JP2019-145322

(51) Int. Cl.
*B41J 29/393* (2006.01)
*B41J 13/00* (2006.01)

(52) U.S. Cl.
CPC ..... *B41J 29/393* (2013.01); *B41J 13/0009* (2013.01)

(58) Field of Classification Search
CPC .. B41J 11/0095; B41J 29/393; B41J 13/0009; B41J 29/38
See application file for complete search history.

(56) References Cited

U.S. PATENT DOCUMENTS

2004/0150155 A1 8/2004 Okitsu et al. ..... 271/262
2019/0283466 A1* 9/2019 Watanabe ..... B41J 11/009

FOREIGN PATENT DOCUMENTS

JP 2004-231403 A 8/2004

* cited by examiner

*Primary Examiner* — Jannelle M Lebron
(74) *Attorney, Agent, or Firm* — Stein IP, LLC

(57) ABSTRACT

An image forming apparatus includes a sheet feeder, an image former, an ultrasonic sensor, and a controller. The image former forms an image on a sheet conveyed. The ultrasonic sensor is used to detect the sheet conveyed. The ultrasonic sensor includes a transmitter circuit which sends ultrasonic waves and a receiver circuit which receives the ultrasonic waves. The ultrasonic sensor outputs an output voltage in accordance with a strength of the ultrasonic waves received by the receiver circuit. The controller recognizes a current air pressure based on a magnitude of the output voltage.

9 Claims, 7 Drawing Sheets

D1

| ULTRASONIC SENSOR OUTPUT VALUE (DETECTION VOLTAGE) (V) | CURRENT AIR PRESSURE (hPa) |
|---|---|
| A1 | B1 |
| A2 | B2 |
| A3 | B3 |
| A4 | B4 |
| ⋮ | ⋮ |
| An | Bn |

FIG.9

| AIR TEMPERATURE (°C) | AIR-TEMPERATURE CORRECTION COEFFICIENT | |
|---|---|---|
| ⋮ | ⋮ | |
| 25 | C25 | |
| 24 | C24 | |
| 23 | C23 | |
| 22 | C22 | |
| 21 | C21 | |
| 20 | 1.0 | REFERENCE AIR TEMPERATURE |
| 19 | C19 | |
| 18 | C18 | |
| 17 | C17 | |
| 16 | C16 | |
| 15 | C15 | |
| ⋮ | ⋮ | |

D2

IMAGE FORMING APPARATUS AND METHOD FOR CONTROLLING IMAGE FORMING APPARATUS

INCORPORATION BY REFERENCE

This application is based upon and claims the benefit of priority from the corresponding Japanese Patent Application No. 2019-145322 filed on Aug. 7, 2019, the entire contents of which are incorporated herein by reference.

BACKGROUND

The present disclosure relates to an image forming apparatus that includes an ultrasonic sensor.

An image forming apparatus forms an image and prints the image on a sheet. For example, multi-functional peripherals and printers are image forming apparatuses. An image forming apparatus may be provided with an ultrasonic sensor. For example, an ultrasonic sensor is used to detect multi-feeding of sheets (two or more sheets conveyed overlapping each other). Multi-feeding can cause a problem such as a sheet jam and a printing failure. The following is a known example of a device that detects multi-feeding.

Specifically, a multi-feeding detection device is known which makes a first judgment and a second judgment on whether or not multi-feeding has occurred. Here, the first judgment is made by emitting ultrasonic waves, from one of opposite sides with respect to a conveyance path of a sheet-shaped member, toward the sheet-shaped member, receiving the ultrasonic waves on the other one of the opposite sides with respect to the conveyance path of the sheet-shaped member to output an ultrasonic reception signal, obtaining and holding, immediately before the emission of the ultrasonic waves, an output value of the ultrasonic-wave reception as a noise signal, and comparing the amplitude of the ultrasonic reception signal with the amplitude of the noise signal. The second judgment is made by detecting a phase variation of the ultrasonic reception signal and based on the detected phase variation. These two methods are combined to detect multi-feeding without fail regardless of external factors such as the sensor-to-sensor distance, the temperature, the humidity, and the air pressure, or the thickness of the sheet-shaped member.

An image forming apparatus may be equipped with an air pressure sensor. With the air pressure sensor, an air pressure in the installation location of the image forming apparatus is measured. In accordance with the measured air pressure, processing in printing is adjusted. In other words, based on the air pressure, a printing operation parameter may be adjusted. For example, based on the measured air pressure, a voltage used for the operation may be adjusted. Or, a level of a voltage applied to a portion that forms an image with coloring materials may be adjusted. An adjustment is performed to maintain a density of a printed matter within an appropriate range under any air pressure.

Unfortunately, however, the air pressure sensor can be relatively expensive. The provision of the air pressure sensor disadvantageously increases production costs of image forming apparatuses. However, without the air pressure sensor, it is impossible to perform an adjustment in accordance with the air pressure. Same contents can be printed in greatly different color densities under different air pressures.

The known apparatus described above is a technology where, based on an output of an ultrasonic sensor, whether or not multi-feeding has occurred is judged using a plurality of methods to thereby prevent erroneous detection of multi-feeding. However, as to the apparatus, nothing is disclosed regarding how to deal with variations of the atmospheric pressure. Nothing is disclosed regarding a sensor for measuring the air pressure, either. Accordingly, with the above-described known apparatus, it is impossible to sufficiently solve the problems described above.

SUMMARY

To solve the above-described problem, according to an aspect of the present disclosure, an image forming apparatus includes a sheet feeder, an image former, an ultrasonic sensor, and a controller. The sheet feeder feeds a sheet. The image former forms an image on the sheet conveyed. The ultrasonic sensor is used to detect the sheet conveyed. The ultrasonic sensor includes a transmitter circuit which sends ultrasonic waves and a receiver circuit which receives the ultrasonic waves from the transmitter circuit. The ultrasonic sensor outputs an output voltage in accordance with a strength of the ultrasonic waves received by the receiver circuit. The controller recognizes a current air pressure based on a magnitude of the output voltage of the ultrasonic sensor.

According to another aspect of the present disclosure, a method for controlling an image forming apparatus includes feeding a sheet, forming an image on the sheet conveyed, using, to detect the sheet conveyed, an ultrasonic sensor which includes a transmitter circuit that sends ultrasonic waves and a receiver circuit that receives the ultrasonic waves from the transmitter circuit, and which outputs an output voltage in accordance with a strength of the ultrasonic waves received by the receiver circuit, and recognizing a current air pressure based on a magnitude of the output voltage of the ultrasonic sensor.

Still other features and advantages provided by the present disclosure will be made further apparent from the following description of embodiments.

BRIEF DESCRIPTION OF THE DRAWINGS

FIG. 9 is a diagram showing an example of air-temperature correction coefficient setting data according to the embodiment.

DETAILED DESCRIPTION

According to the present disclosure, an air pressure is obtained without providing a dedicated sensor for measuring the air pressure. This helps achieve a low-cost image forming apparatus. Hereinafter, with reference to FIGS. 1 to 9, a description will be given of an image forming apparatus according to an embodiment of the present disclosure. The description will be given by taking a printer 100 as an example of the image forming apparatus. It should be noted that the image forming apparatus is not limited to the printer 100. For example, the present disclosure is applicable also to other types of image forming apparatuses such as multi-functional peripherals. Factors such as configurations and arrangements described in the following embodiment are not meant to limit the scope of the present disclosure but are merely explanatory examples.

(Printer 100)

Figure 1:
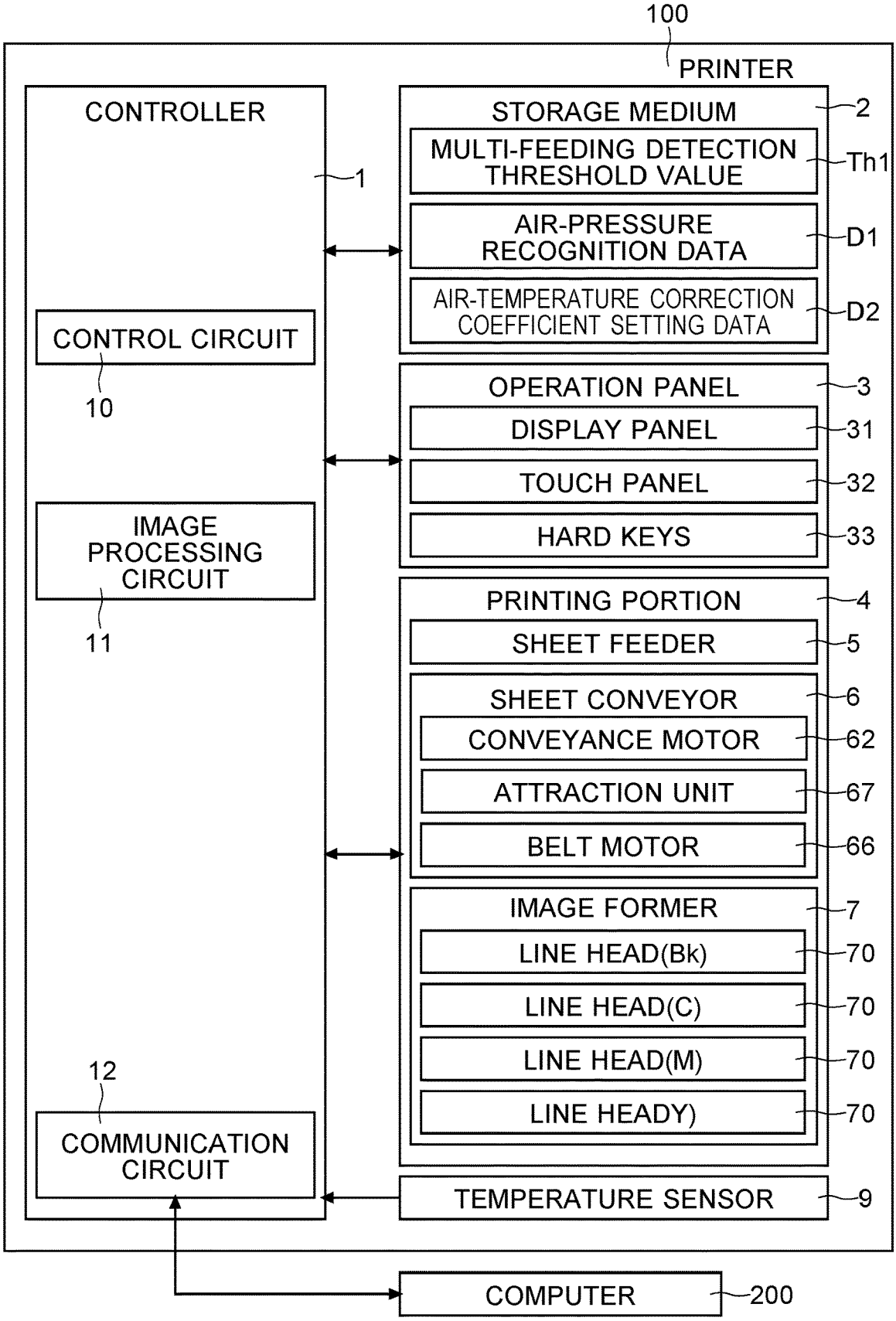
FIG. 1 is a diagram showing an example of a printer according to an embodiment.
Figure 2:
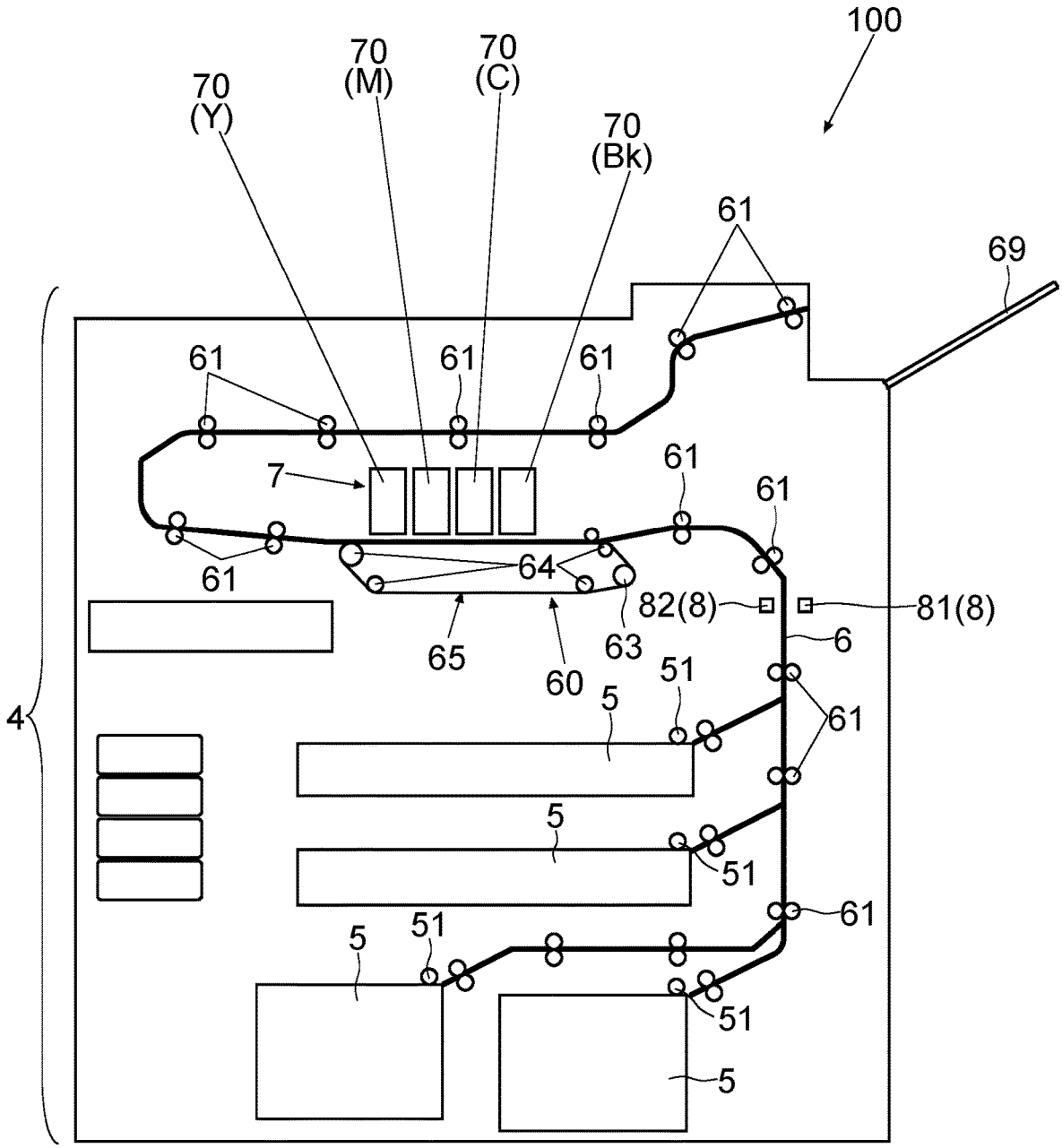
FIG. 2 is a diagram showing the example of the printer according to the embodiment.

With reference to FIGS. 1 and 2, a description will be given of the printer 100 according to the embodiment. As shown in FIG. 1, the printer 100 includes a controller 1, a storage medium 2, an operation panel 3, and a printing portion 4.

The controller 1 controls operations of various portions of the printer 100. The controller 1 includes a control circuit 10, an image processing circuit 11, and a communication circuit 12. For example, the control circuit is a CPU. The control circuit 10 performs processing and calculation, and outputs a signal to control the various portions of the printer 100.

For example, the image processing circuit 11 is an ASIC. The image processing circuit 11 generates image data based on printing data received by the communication circuit 12. For example, the printing data includes data that describes printing contents in a page description language. The image processing circuit 11 analyzes this data and performs rasterizing processing to generate the image data. Further, the image processing circuit 11 performs image processing on the generated image data to generate ejection image data. The ejection image data is used in a print job.

The communication circuit 12 includes a communication control circuit and a communication memory. The communication memory stores communication software therein. The communication circuit 12 communicates with a computer 200. The computer 200 is a personal computer or a server. The communication circuit 12 receives printing data from the computer 200.

The printer 100 includes a RAM, a ROM, and a storage as the storage medium 2. The storage includes either or both of an HDD and an SSD. The controller 1 controls the various portions based on a program and data stored in the storage medium 2.

The operation panel 3 accepts a setting operation performed by a user. The operation panel 3 includes a display panel 31, a touch panel 32, and hard keys 33. The controller 1 makes the display panel 31 display a message, a setting screen, and operation images. The operation images are, for example, buttons, keys, and tabs. Based on an output of the touch panel 32, the controller 1 recognizes which operation image has been operated. In the hard keys 33, a start key and a numeral keys are included. The touch panel 32 and the hard keys 33 accepts a setting operation (a job-related operation) performed by the user.

The printing portion 4 includes a sheet feeder 5, a sheet conveyor 6, and an image former 7. During a print job, the controller 1 makes the sheet feeder 5 feed a sheet. As the sheet feeder 5, a plurality of sheet feeders 5 are provided. The sheet feeders 5 each hold sheets therein. A bundle of sheets are set in each of the sheet feeders 5 (sheet feeding cassettes). The sheet feeders 5 are each provided with a sheet feeding roller 51. During a print job, the controller 1 selects any one of the sheet feeders 5. For example, the controller 1 selects such one of the sheet feeders 5 as has been selected by an input to the operation panel 3. Or, the controller 1 automatically selects such one of the sheet feeders 5 as holds sheets of a size to be used in the print job. During the print job, the controller 1 makes the sheet feeding roller 51 of the selected sheet feeder 5. A sheet feeding motor 52 (see FIG. 5) is provided for rotating the sheet feeding roller 51. By the rotation of the sheet feeding roller 51, a sheet is fed from the selected sheet feeder 5.

The sheet conveyor 6 includes a plurality of conveyance roller pairs 61 for conveying sheets. The sheet conveyor 6 further includes a conveyance motor 62 which rotates the conveyance roller pairs 61. The conveyance roller pairs 61 convey a sheet. The controller 1 makes the sheet conveyor 6 convey a sheet. The sheet conveyor 6 conveys a sheet fed out from any one of the sheet feeders 5 to a discharge tray 69.

The sheet conveyor 6 further includes a conveyance unit 60. The conveyance unit 60 includes a drive roller 63, a plurality of driven rollers 64, and a conveyance belt 65. The conveyance belt 65 is wound around the drive roller 63 and the driven rollers 64. A belt motor 66 is provided for rotating the drive roller 63. By the rotation of the drive roller 63, the conveyance belt 65 and the driven rollers are caused to rotate. A sheet is placed on an outer circumferential upper surface of the conveyance belt 65. By rotating the conveyance belt 65, the conveyance unit 60 conveys the sheet in a horizontal direction.

The sheet conveyor 6 includes an attraction unit 67. To the conveyance unit 60, the attraction unit 67 is attached. For example, the attraction unit 67 electrostatically attracts the sheet onto the conveyance belt 65. The attraction unit 67 may attract the sheet onto the conveyance belt 65 by sucking air. In this case, the conveyance belt 65 has a plurality of air-suction holes formed therein. By thus attracting the sheet, it is possible to prevent displacement of the sheet during conveyance.

The image former 7 ejects ink to the sheet conveyed and thereby forms an image on the sheet. In other words, the image former 7 performs printing. The image former 7 includes a plurality of line heads 70. The line heads 70 eject ink of mutually different colors. For example, the image former 7 includes a line head 70 that ejects black (Bk) ink, a line head 70 that ejects cyan (C) ink, a line head 70 that ejects magenta (M) ink, and a line head 70 that ejects yellow (Y) ink.

The line heads 70 are each fixed. Above the conveyance belt 65, the line heads 70 are provided. A certain gap is provided between each line head 70 and the conveyance belt 65. Through this gap, the sheet passes. Here, for each line head 70, an ink tank is provided to supply ink therefrom.

Figure 3:
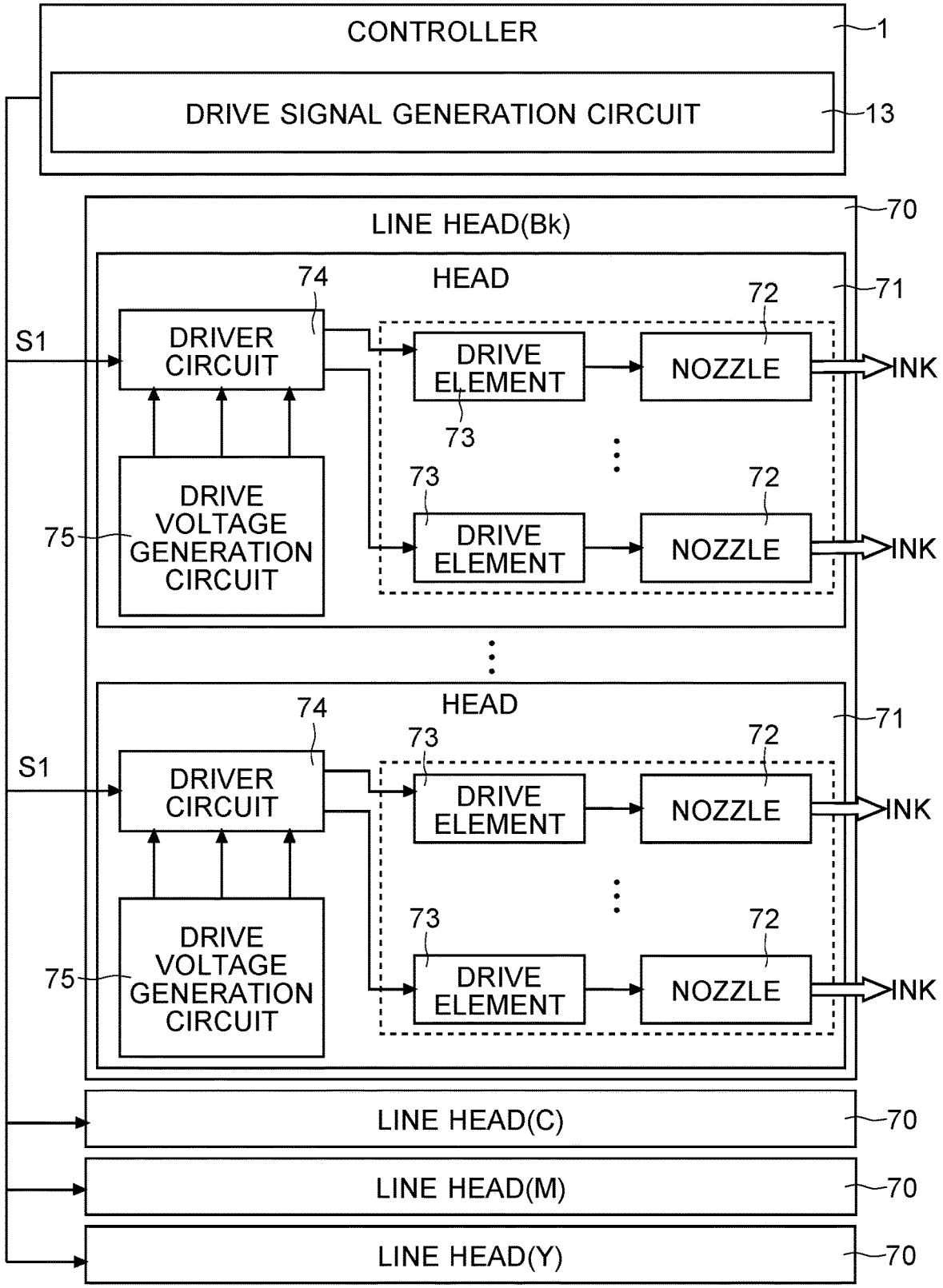
FIG. 3 is a diagram showing an example of a line head according to the embodiment.

The line heads 70 each include a plurality of nozzles 72 (see FIG. 3). The nozzles 72 each have an opening facing the conveyance belt 65. In other words, an ink ejection surface of each line head 70 faces the conveyance belt 65. Ink is ejected from the nozzles 72. Ink impacts the sheet conveyed. Thereby, an image is recorded (formed). The nozzles 72 are arranged in a main scanning direction (a direction orthogonal to a sheet conveyance direction, a direction perpendicular to a surface of the paper sheet on which FIG. 2 is drawn). An interval between the nozzles 72 in the main scanning direction is equivalent to a pitch of one pixel. An ink ejection width of each line head 70 in the main scanning direction is equal to or more than a width of a maximum printable sheet in the main scanning direction.

(Line Head 70)

Next, with reference to FIG. 3, an example of the line heads 70 according to the embodiment will be described.

Here, the line heads 70 for the different colors all have a similar configuration. Thus, in the following description, the line head 70 for black will be taken as an example. The description of the line head 70 for black applies also to the line heads 70 for cyan, magenta, and yellow.

The line head 70 for one color includes two or more (a plurality of) heads 71. In other words, the line head 70 is a combination of a plurality of heads 71. In the line head 70 for one color, the heads 71 are arranged in a linear manner in the main scanning direction or in a zigzag manner.

The heads 71 each include a plurality of nozzles 72. The nozzles 72 are arranged in the main scanning direction. The nozzles 72 are formed to be equally spaced from each other in the main scanning direction. From openings of the nozzles 72, ink is ejected. That is, the image former 7 includes the heads 71 which eject ink for printing. The heads 71 are each fixed such that the nozzles 72 are aligned in a direction perpendicular to the sheet conveyance direction.

Drive elements 73 are provided one for each nozzle 72. The drive elements 73 are pressure-electric elements. For example, the drive elements 73 are piezoelectric elements. The drive elements 73 are each deformed by application of a drive voltage. The larger the drive voltage applied is, the more the drive elements 73 are deformed.

The head 71 includes one or a plurality of driver circuits 74. FIG. 3 shows an example in which one driver circuit 74 is provided in each head 71. The driver circuit 74 turns on and off the application of voltage to each drive element 73. The controller 1 provides each driver circuit 74 with the ejection image data (data indicating which nozzles 72 should eject ink). The ejection image data is data (binary data) that instructs to or not to eject ink. For example, the controller 1 (the image processing circuit 11) transmits to each driver circuit 74 the ejection image data on a line-by-line basis in the main scanning direction.

Based on the ejection image data, the driver circuit 74 applies the drive voltage to the drive elements 73 corresponding to the nozzles 72 that should eject ink. The drive voltage has a pulse waveform, for example. By the application of the drive voltage, the drive elements 73 are deformed. Pressure caused by the deformation is applied to flow paths (not shown) through which ink is supplied to the nozzles 72. The pressure applied to the flow paths causes ink to be ejected from the nozzles 72. On the other hand, the driver circuit 74 does not apply the drive voltage to the drive elements 73 corresponding to pixels for which ink is not to be ejected. The driver circuit 74 practically controls ink ejection.

The head 71 further includes a drive voltage generation circuit 75. The drive voltage generation circuit 75 generates a plurality of types of voltages having mutually different magnitudes. For example, the drive voltage generation circuit 75 includes a plurality of power supply circuits of which output voltages are different from each other. The driver circuit 74 applies to the drive elements 73 any one of the drive voltages generated by the drive voltage generation circuit 75. By changing the magnitude of the drive voltage to apply, the driver circuit 74 can adjust an amount of ink (ink droplets) to be ejected.

The controller 1 further includes a drive signal generation circuit 13. The drive signal generation circuit 13 generates a drive signal S1. The drive signal S1 is a signal for ejecting ink. The drive signal S1 is a clock signal, for example. The head 71 (the driver circuit 74) has ink ejected for one pixel each time the drive signal S1 rises. A reference cycle of ink ejection is determined in advance. The controller 1 makes the drive signal generation circuit 13 generate the drive signal S1 with a frequency corresponding to the reference cycle. For example, the sheet conveyor 6 conveys the sheet by a distance corresponding to one pixel in each cycle of the drive signal S1. By repeating this processing from a start to an end of a page in the sheet conveyance direction (a sub-scanning direction), printing of the page is completed.

(Sheet Conveyance)

Next, with reference to FIGS. 2, 4, and 5, a description will be given of an example of the sheet conveyor 6 according to the embodiment. The printer 100 includes the sheet feeder 5 and the sheet conveyor 6. As shown in FIG. 5, the sheet feeders 5 each include the sheet feeding motor 52 and the sheet feeding roller 51 (a pickup roller). For the sake of convenience, in FIG. 5, only one sheet feeder 5 is illustrated. The sheet feeding motor 52 is provided in each of the sheet feeders 5. The sheet feeding motor 52 is driven to rotate by the sheet feeding roller 51. By the rotation of the sheet feeding roller 51, a sheet is caused to be fed out from the sheet feeder 5. During a print job, the controller 1 rotates any of the sheet feeding motors 52. To perform printing continuously on a plurality of sheets, the controller 1 repeatedly rotates and stops the sheet feeding motor 52 so as to provide a predetermined distance between sheets.

A sheet fed out from the sheet feeder 5 enters the sheet conveyor 6. As shown in FIG. 4, the sheet conveyor 6 includes a conveyance roller pair 61 and a conveyance guide 68. The conveyance roller pair 61 rotates to convey a sheet. The conveyance guide 68 guides the sheet conveyed. FIG. 4 shows an example of such part of the sheet conveyor 6 as conveys a sheet from bottom (the sheet feeder 5) to top (the image former 7).

The sheet conveyor 6 includes one or a plurality of conveyance motors 62. The conveyance motor 62 drives the one or the plurality of conveyance roller pairs 61 to rotate. The conveyance roller pair 61 rotates to convey the sheet. The sheet passes through a conveyance path constituted by the conveyance guide 68. During a print job, the controller 1 rotates the conveyance motor 62.

Here, multi-feeding (a plurality of sheets conveyed overlapping each other) may occur. For example, during conveyance of sheets, part of a preceding sheet and part of a following sheet may overlap each other. Or, two sheets may be conveyed together substantially completely overlapping each other. Multi-feeding of sheets in these manners may cause a sheet jam. Further, when a plurality of sheets pass through the image former 7 in a multi-feeding state, contents of one page are printed across the plurality of sheets. In this manner, printing is performed in vain. When multi-feeding has occurred, the conveyance roller pair 61 (the conveyance motor 62) should be stopped quickly. For this purpose, the printer 100 includes an ultrasonic sensor 8 (see FIG. 2).

The ultrasonic sensor 8 includes a transmitter circuit 81, a receiver circuit 82, an integration circuit 83, and a switch circuit 84. The transmitter circuit 81 and the receiver circuit 82 each include a piezoelectric element (a pressure-electric element). To detect multi-feeding, the controller 1 feeds a pulse signal with a predetermined cycle (frequency) to the transmitter circuit 81. The application of voltage (the pulse signal) deforms the piezoelectric element. As a result, the transmitter circuit 81 emits ultrasonic waves with the frequency of the fed pulse signal. The transmitter circuit 81 sends ultrasonic waves.

The receiver circuit 82 receives the ultrasonic waves emitted from the transmitter circuit 81. The piezoelectric element (the pressure-electric element) of the receiver circuit 82 outputs an electric charge (a voltage) in accordance with a strength of pressure (sound pressure) of the ultrasonic waves. Here, the receiver circuit 82 may include an amplifier circuit which amplifies an output of the piezoelectric element. In other words, the receiver circuit 82 may output an electric charge (a voltage) obtained by amplifying the output of the piezoelectric element.

Figure 4:
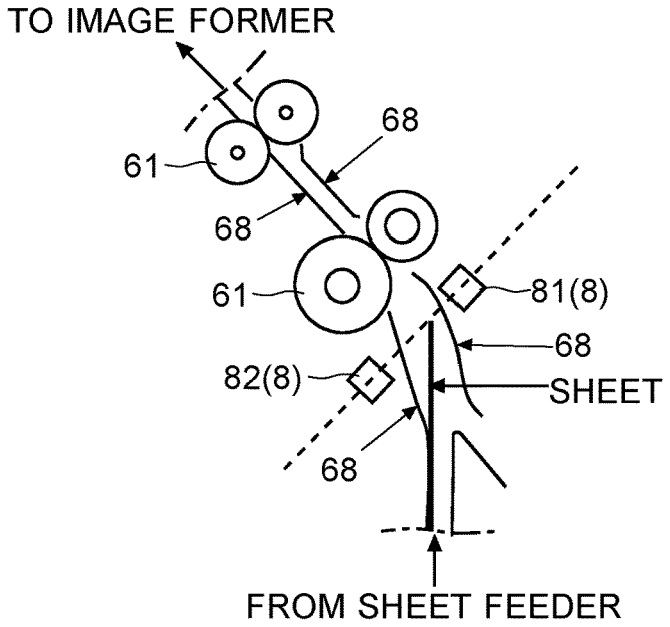
FIG. 4 is a diagram showing an example of a sheet conveyor according to the embodiment.
Figure 5:
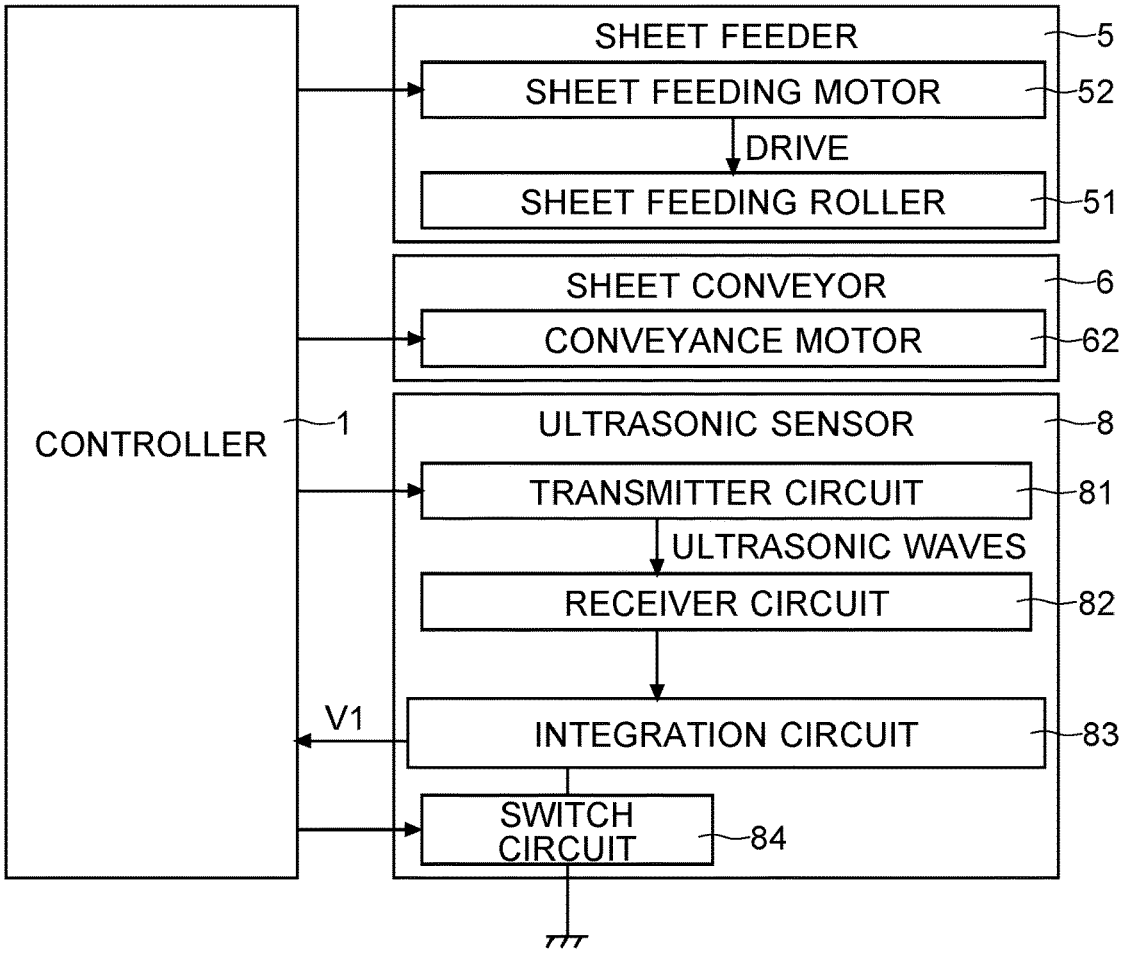
FIG. 5 is a diagram showing the example of the sheet conveyor according to the embodiment.

As shown in FIG. 4, the transmitter circuit 81 and the receiver circuit 82 are arranged so as to sandwich therebetween the sheet conveyed. An ultrasonic-wave emitting surface of the transmitter circuit 81 and an ultrasonic-wave receiving surface of the receiver circuit 82 face each other. Between the transmitter circuit 81 and the receiver circuit 82, the sheet passes. To detect multi-feeding before ink is ejected (before sheets reach the image former 7), the ultrasonic sensor 8 is provided on an upstream side of the image former 7 in the sheet conveyance direction (see FIG. 2). FIGS. 2 and 4 show an example where the ultrasonic sensor 8 is provided at such part of the sheet conveyance path as is located between the image former 7 and the most downstream sheet feeder 5 (the uppermost sheet feeder 5).

The integration circuit 83 is a circuit that stores therein the output (electric charge) of the receiver circuit 82. For example, the integration circuit 83 includes a capacitor. The capacitor performs charging of the electric charge. During the charging, each time the receiver circuit 82 receives ultrasonic waves and outputs a pulse signal, a voltage across terminals of the capacitor increases. A voltage based on the electric charge stored in the capacitor is fed to the controller 1 as a detection voltage V1.

The controller 1 performs A/D conversion of the fed detection voltage V1, and recognizes a magnitude of the detection voltage V1. Here, the ultrasonic sensor 8 may be provided with an A/D conversion circuit, and the A/D conversion circuit may generate digital data indicating the magnitude of the detection voltage V1. In this case, the digital data generated by the A/D conversion circuit is fed to the controller 1. The controller 1, based on the fed digital data, recognizes the magnitude of the detection voltage V1.

The ultrasonic sensor 8 includes the switch circuit 84. The switch circuit 84 is a switch for removing the electric charge from the integration circuit 83 (the capacitor). The switch circuit 84 includes, for example, a transistor connected to the controller 1 (the control circuit 10), a ground, and the capacitor. The controller 1 controls ON/OFF of the switch circuit 84. To remove the electric charge from the integration circuit 83, the controller 1 turns on the switch circuit 84. For example, when the switch circuit 84 is turned on, the capacitor becomes connected to the ground. Specifically, a terminal of the capacitor via which the output of the receiver circuit 82 is received is connected to the ground. Thereby, discharging is performed. To perform charging of the integration circuit 83, the controller 1 turns off the switch circuit 84. For example, when the switch circuit 84 is turned off, the connection is released between the terminal of the capacitor via which the output of the receiver circuit 82 is received and the ground. Thereby, a chargeable state is recovered.

Based on the magnitude of the output voltage (the detection voltage V1) of the ultrasonic sensor 8, the controller 1 detects multi-feeding of sheets. Detection of multi-feeding is performed by repeating first processing (emission of ultrasonic waves), second processing (reception of the ultrasonic waves and charging in the integration circuit 83), third processing (turning on the switch circuit 84, starting of discharging), and fourth processing (completion of discharging by the switch circuit 84 and turning off the switch circuit 84). For example, after a print job is started, the controller 1 repeats the first to fourth processing until the last sheet in the print job passes through the ultrasonic sensor 8.

First, before starting detection of multi-feeding, as preliminary processing, the controller 1 performs the third processing and the fourth processing. This is done to discharge the electric charge having been charged before emission of ultrasonic waves to zero.

In the first processing, the controller 1 feeds a pulse signal (a clock signal) with a predetermined number of successive pulses to the transmitter circuit 81. The predetermined number of pulses are, for example, ten and several pulses. The controller 1 feeds the transmitter circuit 81 with a pulse signal having successive pulses with a predetermined frequency, amplitude, and a duty ratio. On receiving this pulse signal, the transmitter circuit 81 emits ultrasonic waves.

In the second processing, the receiver circuit 82 receives the transmitted ultrasonic waves. The voltage that the receiver circuit 82 outputs is charged in the integration circuit 83. Depending on a strength of the ultrasonic waves having reached the receiver circuit 82, the output voltage of the receiver circuit 82 and the detection voltage V1 outputted by the integration circuit 83 vary in magnitude. The ultrasonic sensor 8 (the integration circuit 83) outputs a voltage in accordance with the strength (a magnitude of sound pressure) of the ultrasonic waves that the receiver circuit 82 has received. The controller 1 recognizes the magnitude of the detection voltage V1 at a lapse of a predetermined waiting time from the start of the emission of the ultrasonic waves (the start of the feeding of the pulse signal). The predetermined waiting time is equal to or longer than a sum of a time obtained by dividing a distance between the transmitter circuit 81 and the receiver circuit 82 by a sound speed and a time required to emit the pulse signal with the predetermined number of pulses.

The detection voltage V1 is smallest when multi-feeding has occurred, larger when there is one sheet between the transmitter circuit 81 and the receiver circuit 82, and still larger when there is no sheet between the transmitter circuit 81 and the receiver circuit 82. When the detection voltage V1 is smaller than a multi-feeding detection threshold value Th1, which is determined in advance, the controller 1 recognizes that multi-feeding has occurred. The storage medium 2 stores therein the multi-feeding detection threshold value Th1 in a non-volatile manner (see FIG. 1). The controller 1 refers to the multi-feeding detection threshold value Th1 stored in the storage medium 2.

After the start of the emission of the ultrasonic waves, the controller 1 performs the third processing after recognizing the magnitude of the detection voltage V1. The controller 1 turns on the switch circuit 84. After turning on the switch circuit 84, at a lapse of a time sufficient to remove the electric charge, the controller 1 turns off the switch circuit 84 (the fourth processing). After the print job is started, if the last sheet has not passed the ultrasonic sensor 8, the controller 1 performs the first processing again. The controller 1 repeats the first to fourth processing.

(Recognition of Current Air Pressure)

Next, with reference to FIGS. 6 to 9, a description will be given of an example of a method for obtaining an air pressure in the printer 100 according to the embodiment. An amount of ink ejected is affected by air pressure (atmospheric pressure). Under a lower air pressure, ink is ejected more easily. Under a higher air pressure, ink is ejected less easily. Under a same drive voltage (the voltage applied to the drive element 73), a larger amount of ink is ejected under a low air pressure than under a high air pressure.

To have a uniform amount of ink ejected each time, it is necessary to know a magnitude of a current air pressure. Conventionally, to measure an air pressure, a dedicated sensor is provided for air-pressure detection. However, the provision of the dedicated sensor increases the production costs of image forming apparatuses. To prevent this, in the printer 100, a current air pressure is obtained by using the ultrasonic sensor 8. A current air pressure is specifically a current air pressure at the installation location of the printer 100.

Figures 7, 8:
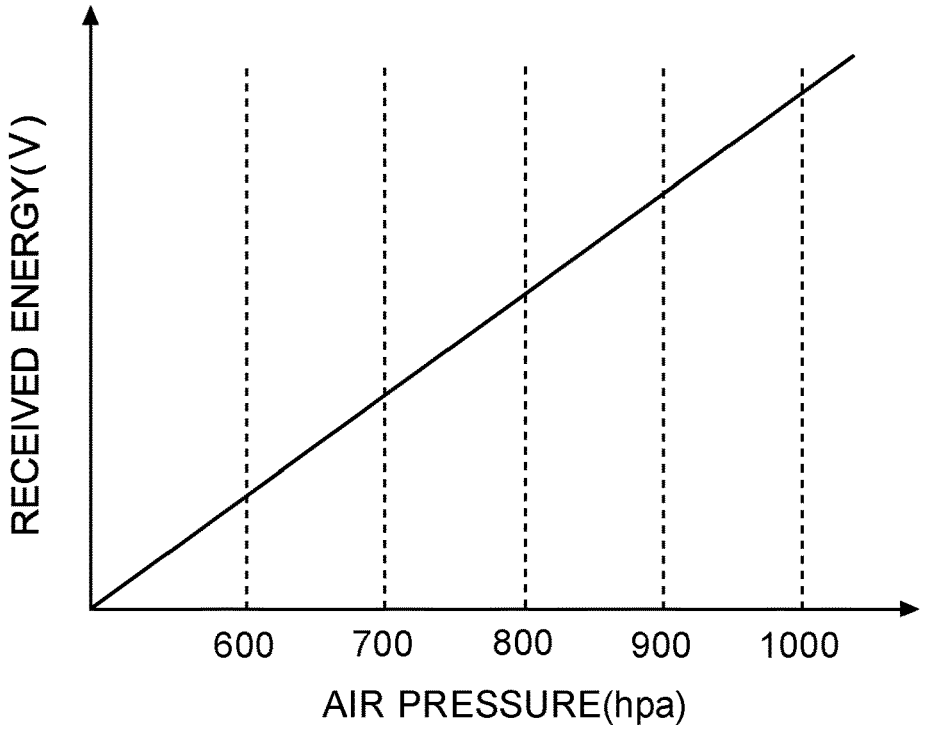
FIG. 7 is a diagram showing an example of a relationship between received energy of ultrasonic waves and air pressure.
FIG. 8 is a diagram showing an example of air-pressure recognition data according to the embodiment.

First, a relationship between air pressure and sound will be described. Sound propagates in a form of air vibration. As air pressure lowers, air density decreases. Thus, under a lower air pressure, it is less easy for sound to propagate. Conversely, under a higher air pressure, it is easier for sound to propagate. Ultrasonic waves are a type of sound waves. Under a lower air pressure, ultrasonic energy receivable by the receiver circuit 82 is reduced. FIG. 7 is a diagram showing an example of a relationship between air pressure and ultrasonic energy receivable by the receiver circuit 82.

Specifically, energy I ($W/m^2$) of sound passing a unit area perpendicular to a travelling direction of waves of the sound per unit time can be described by the following formula (1):

$$I=pu \tag{1}$$

Here, p (hPa) represents a sound-pressure effective value of a pressure of the sound propagating in the air, and u (m/s) represents a particle speed of medium particles vibrated by the sound waves.

When the sound waves are plane waves, the following formula (2) holds:

$$u=p/\rho c \tag{2}$$

Here, ρ ($kg/m^3$) represents a volume density of the medium (air density), and c (m/s) represents a sound speed in the medium.

By substituting formula (2) into formula (1), the following formula (3) is obtained:

$$I=p^2/\rho c \tag{3}$$

By modifying formula (3) into a formula for air pressure ρ ($kg/m^3$), the following formula (4) is obtained:

$$\rho=p^2/Ic \tag{4}$$

Here, for simplicity, by substituting the following formula (5), formula (4) can be recast as the following formula (6):

$$E=p^2/I \tag{5}$$

$$\rho=E/c \tag{6}$$

Here, a sound speed c (m/s) under a temperature t (° C.) can be described by the following formula (7):

$$c=331.5+0.6t \tag{7}$$

A relationship between air density ρ($kg/m^3$) and air pressure P (hPa) can be described by the following formula (8):

$$P=\rho R(t+273.15) \tag{8}$$

Here, R represents a gas constant (=2.87).

By using formulae (6), (7), and (8), the following formula (9) for air pressure P (hPa) is obtained:

$$P=2.87E\times(t+273.15)/(331.5+0.6t) \tag{9}$$

Formula (9) shows that air pressure P (hPa) can be obtained based on temperature t (° C.) and a variable E. Here, it is known that, when the temperature (air temperature) is 20° C., in formula (5), the relationship shown by the following formula (10) holds:

$$I\approx p \tag{10}$$

By using formula (10), formula (9) can be simplified into the following formula (11).

$$P\approx 2.45p \tag{11}$$

Formula (11) shows that air pressure P (hPa) has a relationship with the effective value p (hPa) of sound pressure. Based on an effective value p (hPa) of sound pressure, it is also possible to obtain an air pressure P (hPa). The ultrasonic sensor 8 (the receiver circuit 82) is a sensor for reading sound pressure as a voltage. It is clear that an air pressure can be obtained by using the ultrasonic sensor 8.

Figure 6:
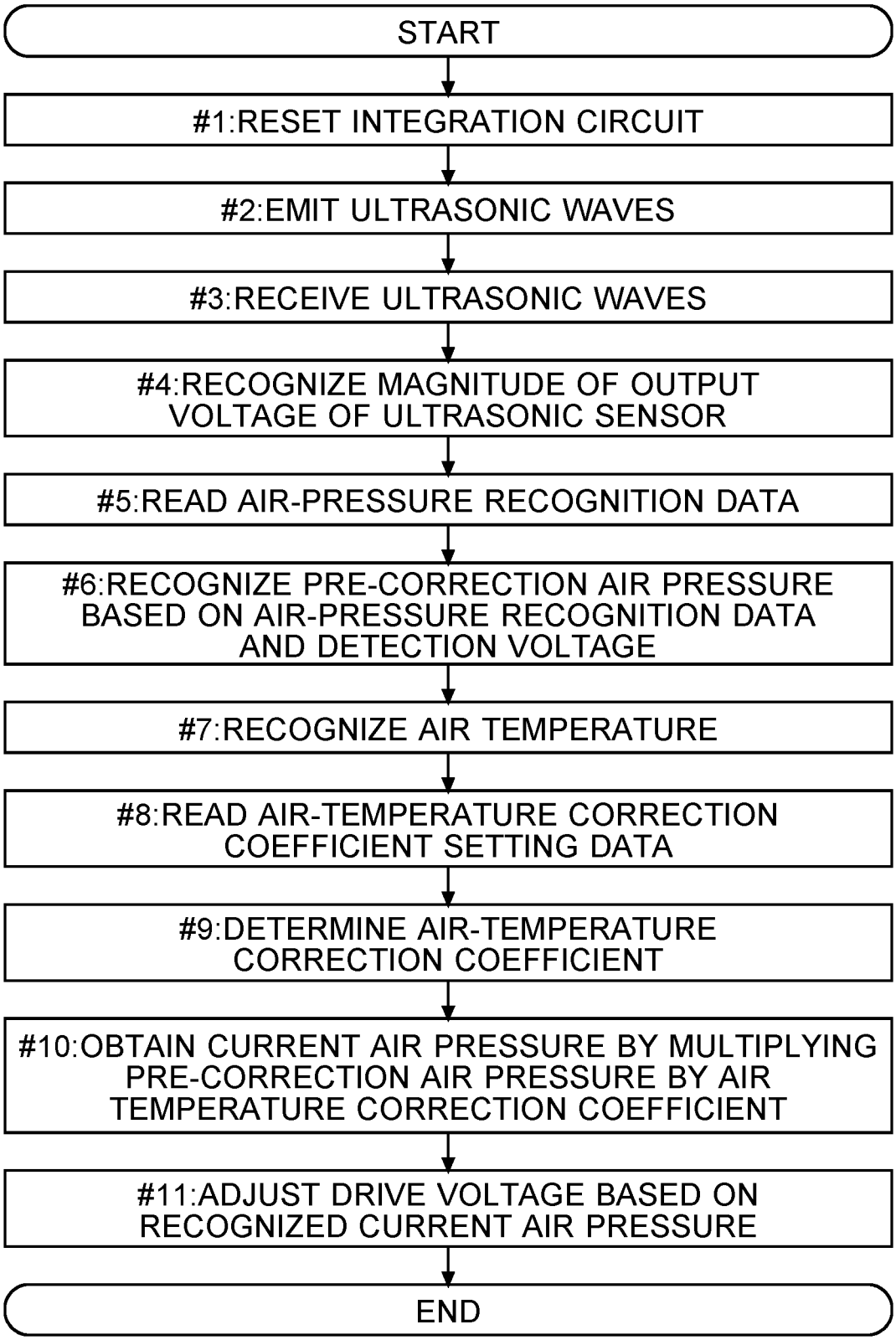
FIG. 6 is a diagram showing an example of a method for obtaining a current air pressure in the printer according to the embodiment.

Next, with reference to FIG. 6, a description will be given of an example of a flow of obtaining a current air pressure (a current air pressure at the installation location of the printer 100). "START" in FIG. 6 is a time point at which recognition of the current air pressure is started. For example, the controller 1 may start recognizing the current air pressure when a main power supply of the printer 100 is turned on. The controller 1 may start recognizing the current air pressure at regular intervals. For example, the current air pressure may be obtained about once per hour. The controller 1 may obtain the current air pressure before starting a print job.

First, the controller 1 resets the integration circuit 83 (step #1). Specifically, the controller 1 turns on the switch circuit 84, and removes the electric charge of the integration circuit 83. Then, the controller 1 turns off the switch circuit 84.

Next, the controller 1 makes the transmitter circuit 81 emit ultrasonic waves (step #2). Specifically, the controller 1 feeds a pulse signal (a clock signal) with a predetermined number of successive pulses to the transmitter circuit 81. The controller 1 feeds a pulse signal having a predetermined frequency, amplitude, and duty ratio to the transmitter circuit 81. On receiving this pulse signal, the transmitter circuit 81 emits ultrasonic waves.

The receiver circuit 82 receives the ultrasonic waves (step #3). Note that the controller 1 obtains the current air pressure when a sheet is not passing between the transmitter circuit 81 and the receiver circuit 82. Next, the controller 1 recognizes the magnitude of the output voltage (the detection voltage V1) of the ultrasonic sensor 8 (the integration circuit 83) (step #4). After the receiver circuit 82 receives the ultrasonic waves from start to end, the controller 1 recognizes the magnitude of the detection voltage V1.

Next, the controller 1 reads air-pressure recognition data D1 into the RAM (step #5). The storage medium 2 stores the air-pressure recognition data D1 in the ROM or in the storage in a non-volatile manner (see FIG. 1). For reference, the controller 1 reads the air-pressure recognition data D1.

The air-pressure recognition data D1 is table data that defines magnitudes of the current air pressure respectively corresponding to magnitudes of the output voltage (the detection voltage V1) of the ultrasonic sensor 8. FIG. 8 shows an example of the air-pressure recognition data D1. In the air-pressure recognition data D1, values of air pressure corresponding to respective magnitudes of the detection voltage V1 are defined. In FIG. 8, A1, A2, A3, A4, and An each indicate a magnitude of the detection voltage V1, B1, B2, B3, B4, and Bn each indicate a corresponding current air pressure.

For example, the air-pressure recognition data D1 may be produced based on results of experiments of measuring air pressures corresponding to different magnitudes of the detection voltage V1. A formula (a function) for obtaining a sound pressure from the detection voltage V1 may be determined through experiments. The air-pressure recognition data D1 may be produced with values obtained by using the thus determined formula and formula (11) described above. In this case, from the air-pressure recognition data D1, the air pressure corresponding to the detection voltage V1 when the air temperature is 20° C. can be obtained.

Hereinafter, the air temperature used as a reference in producing and defining the air-pressure recognition data D1 will be referred to as the reference air temperature. In this description, the reference air temperature is 20° C.

The controller 1 recognizes a pre-correction air pressure based on the air-pressure recognition data D1 and a recognized magnitude of the detection voltage V1 (step #6). Thereby, the controller 1 can recognize a substantially correct value indicating the air pressure.

Next, based on an output of a temperature sensor 9, the controller 1 recognizes an air temperature (step #7). The printer 100 includes the temperature sensor 9 which detects an air temperature (see FIG. 1). The temperature sensor 9 outputs a voltage of which a magnitude varies in accordance with the air temperature (room temperature). Based on the output of the temperature sensor 9, the controller 1 recognizes the air temperature. For example, the temperature sensor 9 is provided near the image former 7 (any of the line heads 70).

Air temperature affects air pressure. There is a tendency that air with a higher temperature has a larger volume and a lower pressure. When the current air temperature is higher than the reference air temperature, to obtain a correct current air pressure, the air pressure (the pre-correction air pressure) recognized in step #6 may be corrected in a direction of becoming smaller.

On the other hand, there is a tendency that air with a lower temperature has a smaller volume and a higher pressure. When the current air temperature is lower than the reference air temperature, to obtain a correct current air pressure, the pre-correction air pressure may be corrected in a direction of becoming larger.

Thus, the controller 1 reads air-temperature correction coefficient setting data D2 (step #8). The storage medium 2 (the ROM or the storage) stores therein the air-temperature correction coefficient setting data D2 in a non-volatile manner (see FIG. 1). For reference, the controller 1 reads the air-temperature correction coefficient setting data D2. The air-temperature correction coefficient setting data D2 is table data that defines air-temperature correction coefficients respectively corresponding to recognized temperatures.

Next, based on the current air temperature and the air-temperature correction coefficient setting data D2, the controller 1 determines an air-temperature correction coefficient (step #9). Then, the controller 1 multiplies the air pressure having been recognized in step #6 by the air-temperature correction coefficient and thereby obtains the current pressure (step #10).

FIG. 9 is a diagram showing an example of the air-temperature correction coefficient setting data D2. In the data, air-temperature correction coefficients are determined corresponding to respective air temperatures. For example, experiments are conducted to obtain appropriate air-temperature correction coefficients, and an air-temperature correction coefficient is determined for each of the air temperatures.

FIG. 9 shows an example of the air-temperature correction coefficient setting data D2 when the reference air temperature is 20° C. When the current air temperature is equal to the air temperature set as the reference in determining the air-pressure recognition data D1, correction is not necessary. Thus, the air-temperature correction coefficient for the reference air temperature may be 1.0.

There is a tendency that air with an increased temperature has a larger volume and a lower pressure. Thus, for a temperature higher than the reference air temperature, a value smaller than 1.0 may be determined as the air-temperature correction coefficient. In the example shown in FIG. 9, the air-temperature correction coefficients C21 to C25 may each be a value smaller than 1.0. As a result, when the recognized air temperature is higher than the reference air temperature, the controller 1 determines a value smaller than 1.0 as the air-temperature correction coefficient.

Further, according as air temperature rises, a volume expansion rate of air increases. As a result, there is a tendency that air pressure lowers according as air temperature rises. Thus, the air-temperature correction coefficients for temperatures higher than the reference air temperature may be determined such that the higher the air temperature is than the reference air temperature, the smaller the air-temperature correction coefficient is. In the example shown in FIG. 9, the air-temperature correction coefficients may be determined such that the relationship C25<C24<C23<C22<C21 holds. As a result, the higher the recognized air temperature is than the reference air temperature, the smaller value the controller 1 determines as the air-temperature correction coefficient.

On the other hand, there is a tendency that air with a lower temperature has a smaller volume and a higher pressure. Thus, for a temperature lower than the reference air temperature, a value larger than 1.0 may be determined as the air-temperature correction coefficient. In the example shown in FIG. 9, the air-temperature correction coefficients C15 to C19 may each be a value larger than 1.0. As a result, when the recognized air temperature is lower than the reference air temperature, the controller 1 determines a value larger than 1.0 as the air-temperature correction coefficient.

Further, according as air temperature lowers, a volume decrease rate of air increases. As a result, there is a tendency that air pressure rises according as air temperature lowers. Thus, the air-temperature correction coefficients for temperatures lower than the reference air temperature may be determined such that the lower the air temperature is than the reference air temperature, the larger the air-temperature correction coefficient is. In the example shown in FIG. 9, the air-temperature correction coefficients may be determined such that the relationship C19<C18<C17<C16<C15 holds. As a result, the lower the recognized air temperature is than the reference air temperature, the larger value the controller 1 determines as the air-temperature correction coefficient.

Then, based on the obtained current air pressure, the controller 1 adjusts the drive voltage (the voltage applied to the drive element 73) (step #11). Specifically, the controller 1 increases the drive voltage as the obtained current pressure is higher. For a sufficient amount of ink to be ejected even under a high air pressure, a higher pressure is applied to the ink flow path. The controller 1 reduces the drive voltage as the obtained current pressure is lower. When the air pressure is low, to prevent ejection of an excessive amount of ink, a lower pressure is applied to the ink flow path.

In the above-described example, an air temperature is measured, correction based on the measured air temperature is performed, and a current air pressure is obtained. However, the pre-correction air pressure obtained in step #6 may be used as the current air pressure. In other words, the step of the correction based on air temperature may be omitted. In this case, the controller 1 omits steps #7 to #10, and obtains the pre-correction air pressure as the current air pressure.

As has been described above, the image forming apparatus (the printer 100) according to the embodiment includes the sheet feeder 5, the image former 7, the ultrasonic sensor 8, and the controller 1. The sheet feeder 5 feeds a sheet. The image former 7 forms an image on the sheet conveyed. The ultrasonic sensor 8 is used to detect the sheet conveyed. The ultrasonic sensor 8 includes the transmitter circuit 81 which sends ultrasonic waves and the receiver circuit 82 which receives the ultrasonic waves from the transmitter circuit 81. The ultrasonic sensor 8 outputs a voltage in accordance with the strength of the ultrasonic waves received by the receiver circuit 82. The controller 1 recognizes the current air pressure based on the magnitude of the output voltage (the detection voltage V1) of the ultrasonic sensor 8.

It is possible to obtain the current air pressure in the installation environment of the image forming apparatus by using the ultrasonic sensor 8. The ultrasonic sensor 8 can be used as a sensor that performs a plurality of detection operations. In other words, the ultrasonic sensor 8, which performs a detection operation regarding sheets, can simultaneously be used also as a sensor for obtaining the current air pressure. There is no need of providing a dedicated sensor (an air pressure sensor) for measuring air pressure. This helps reduce the production costs of image forming apparatuses. Since the current air pressure can be obtained, printing adjustment can be done in accordance with air pressure.

The image forming apparatus includes the temperature sensor 9 which detects air temperature. The controller 1 recognizes an air temperature based on the output of the temperature sensor 9. The controller 1 determines an air-temperature correction coefficient in accordance with the air temperature recognized. Based on the magnitude of the output voltage of the ultrasonic sensor 8, the controller 1 recognizes a pre-correction air pressure. The controller 1 obtains, as the current air pressure, a value resulting from multiplying the pre-correction air pressure recognized by the air-temperature correction coefficient. Air pressure varies with air temperature. The correct current air pressure can be obtained by performing correction in accordance with the air temperature.

Generally, as the air temperature increases, the air pressure decreases in a room. Conversely, as air temperature decreases, room air pressure increases. Thus, when the recognized air temperature is higher than the predetermined reference air temperature, the controller 1 determines a value smaller than 1.0 as the air-temperature correction coefficient. When the recognized air temperature is lower than the reference air temperature, the controller 1 determines a value larger than 1.0 as the air-temperature correction coefficient. In a case where the air temperature is high, the air-temperature correction coefficient can be determined such that the current air pressure becomes small. In a case where the air temperature is low, the air-temperature correction coefficient can be determined such that the current air pressure becomes large. Correction can be performed appropriately in accordance with the air temperature, and the correct current air pressure can be obtained.

The higher the recognized air temperature is than the reference air temperature, the smaller value the controller 1 determines as the air-temperature correction coefficient. The lower the recognized air temperature is than the reference air temperature, the larger value the controller 1 determines as the air-temperature correction coefficient. The air-temperature correction coefficient can be determined such that a correction amount is larger as temperature is higher or as temperature is lower. Correction can be performed appropriately in accordance with the air temperature, and the correct current air pressure can be obtained.

In ink ejection, when the pressure applied to the ink flow path is the same, the lower the air pressure is, the more ink is ejected from the nozzle 72. This is because a tip end (a liquid surface of the ink) of the nozzle 72 is pushed by a weaker force. On the other hand, the higher the air pressure is, the less ink is ejected from the nozzle 72. The image former 7 includes the head 71 which ejects ink for printing. The head 71 includes the plurality of nozzles 72 and the plurality of drive elements 73. The drive elements 73 are provided one for each of the nozzles 72. Each of the drive elements 73 is more deformed as the drive voltage applied is larger. A nozzle 72 corresponding to a deformed drive element 73 ejects ink. The controller 1 applies the drive voltage to one of the drive elements 73 that corresponds to one of the nozzles 72 that is to be made to eject ink. The controller 1 increases the drive voltage as the obtained current air pressure is higher. The controller 1 reduces the drive voltage as the obtained current air pressure is lower. A uniform amount of ink can be ejected from each nozzle 72 regardless of the magnitude of the air pressure. The magnitude of the drive voltage can be adjusted in accordance with the magnitude of the current air pressure.

The image forming apparatus includes the storage medium 2. The storage medium 2 stores therein the air-pressure recognition data D1. The air-pressure recognition data D1 is data that defines magnitudes of the current air pressure corresponding to magnitudes of the output voltage of the ultrasonic sensor 8. The controller 1 obtains the current air pressure by referring to the output voltage of the ultrasonic sensor 8 and the air-pressure recognition data D1. Based on the output value of the ultrasonic sensor 8, the current air pressure can be recognized.

The ultrasonic sensor 8 is arranged such that the ultrasonic-wave emitting surface of the transmitter circuit 81 and the ultrasonic-wave receiving surface of the receiver circuit 82 sandwich therebetween the sheet conveyed. The controller 1 detects multi-feeding of sheets based on the magnitude of the output voltage of the ultrasonic sensor 8. By using the ultrasonic sensor 8, occurrence of multi-feeding can be detected. The ultrasonic sensor 8 can be used not only as a sensor for obtaining the air pressure but also as a sensor for detecting multi-feeding. The ultrasonic sensor 8 can have a plurality of functions (detection items).

The ultrasonic sensor 8 includes the integration circuit 83 which performs charging of the voltage outputted by the receiver circuit 82 and the switch circuit 84 for removing the electric charge from the integration circuit 83. The controller 1 feeds a pulse signal with the predetermined number of successive pulses to the transmission circuit 81 to make the transmission circuit 81 emit ultrasonic waves. The controller 1 recognizes the magnitude of the detection voltage V1 which is outputted by the integration circuit 83. Based on the magnitude of the detection voltage V1, the controller 1 obtains the current air pressure. By using the integration circuit 83 and the switch circuit 84, the correct current air pressure can be obtained.

The controller 1 obtains the current air pressure when no sheet is passing between the transmitter circuit 81 and the receiver circuit 82. The correct current air pressure can be obtained based on the output of the receiver circuit 82 when no sheet is passing.

The present disclosure is usable in image forming apparatuses.

What is claimed is:

1. An image forming apparatus comprising:
a sheet feeder which feeds a sheet;
an image former which forms an image on the sheet conveyed;
an ultrasonic sensor
which is used for detecting the sheet conveyed,
which includes a transmitter circuit which sends ultrasonic waves and a receiver circuit which receives the ultrasonic waves from the transmitter circuit, and
which outputs an output voltage in accordance with a strength of the ultrasonic waves received by the receiver circuit;
a controller which recognizes a current air pressure based on a magnitude of the output voltage of the ultrasonic sensor; and
a temperature sensor which detects an air temperature,
wherein
the controller
recognizes the air temperature based on an output of the temperature sensor,
determines an air-temperature correction coefficient in accordance with the air temperature recognized,
recognizes a pre-correction air pressure based on the magnitude of the output voltage of the ultrasonic sensor, and
obtains, as the current air pressure, a value resulting from multiplying the pre-correction air pressure recognized by the air-temperature correction coefficient.

2. The image forming apparatus according to claim 1,
wherein
the controller
determines a value smaller than 1.0 as the air-temperature correction coefficient when the air temperature recognized is higher than a reference air temperature, and
determines a value larger than 1.0 as the air-temperature correction coefficient when the air temperature recognized is lower than the reference air temperature.

3. The image forming apparatus according to claim 2,
wherein
the controller
determines a smaller value as the air-temperature correction coefficient as the air temperature recognized is higher than the reference air temperature, and
determines a larger value as the air-temperature correction coefficient as the air temperature recognized is lower than the reference air temperature.

4. The image forming apparatus according to claim 1 further comprising a storage medium which stores air-pressure recognition data therein,
wherein
the air-pressure recognition data is data that defines a magnitude of the current air pressure corresponding to the magnitude of the output voltage of the ultrasonic sensor, and
the controller obtains the current air pressure by referring to the output voltage of the ultrasonic sensor and the air-pressure recognition data.

5. The image forming apparatus according to claim 1,
wherein
the ultrasonic sensor is arranged such that an ultrasonic-wave emitting surface of the transmitter circuit and an ultrasonic-wave receiving surface of the receiver circuit sandwiches therebetween the sheet conveyed, and
the controller detects multi-feeding of sheets based on the magnitude of the output voltage of the ultrasonic sensor.

6. The image forming apparatus according to claim 1,
wherein
the ultrasonic sensor includes
an integration circuit which performs charging of a voltage that the receiver circuit outputs, and
a switch circuit for removing an electric charge from the integration circuit, and
the controller
feeds a pulse signal with a predetermined number of successive pulses to the transmitter circuit to make the transmitter circuit emit the ultrasonic waves,
recognizes a magnitude of a detection voltage outputted by the integration circuit, and
obtains the current air pressure based on the magnitude of the detection voltage.

7. The image forming apparatus according to claim 1,
wherein
the controller obtains the current air pressure when no sheet is passing between the transmitter circuit and the receiver circuit.

8. An image forming apparatus comprising:
a sheet feeder which feeds a sheet;
an image former which forms an image on the sheet conveyed;
an ultrasonic sensor
which is used for detecting the sheet conveyed,
which includes a transmitter circuit which sends ultrasonic waves and a receiver circuit which receives the ultrasonic waves from the transmitter circuit, and
which outputs an output voltage in accordance with a strength of the ultrasonic waves received by the receiver circuit; and
a controller which recognizes a current air pressure based on a magnitude of the output voltage of the ultrasonic sensor,
wherein
the image former includes a head which performs printing by ejecting ink,
the head includes a plurality of nozzles and a plurality of drive elements,
the drive elements are provided one for each of the nozzles,
each of the drive elements is more deformed as a drive voltage applied thereto is larger,
the nozzle that corresponds to a deformed one of the drive elements ejects ink,
the controller
applies the drive voltage to one of the drive elements that is to be made to eject ink,
increases the drive voltage as the current air pressure recognized is higher, and
reduces the drive voltage as the current air pressure recognized is lower.

9. A method for controlling an image forming apparatus, the method comprising:
feeding a sheet;
forming an image on the sheet conveyed;
using, to detect the sheet conveyed, an ultrasonic sensor
which includes a transmitter circuit which sends ultrasonic waves and a receiver circuit which receives the ultrasonic waves from the transmitter circuit, and
which outputs an output voltage in accordance with a strength of the ultrasonic waves received by the receiver circuit;

recognizing a current air pressure based on a magnitude of the output voltage of the ultrasonic sensor; and detecting an air temperature, wherein the air temperature is recognized based on an output of a temperature sensor, an air-temperature correction coefficient is determined in accordance with the air temperature recognized, a pre-correction air pressure is recognized based on the magnitude of the output voltage of the ultrasonic sensor, and as the current air pressure, a value resulting from multiplying the pre-correction air pressure recognized by the air-temperature correction coefficient is obtained.

* * * * *